US009126253B2

(12) United States Patent
Ichijo et al.

(10) Patent No.: US 9,126,253 B2
(45) Date of Patent: Sep. 8, 2015

(54) MOLD FOR PRESS FORMING

(75) Inventors: Naoki Ichijo, Nisshin (JP); Yoshiya Sato, Nisshin (JP); Isao Nojiri, Nisshin (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 13/879,632

(22) PCT Filed: Jan. 28, 2011

(86) PCT No.: PCT/JP2011/051826
§ 371 (c)(1),
(2), (4) Date: Apr. 16, 2013

(87) PCT Pub. No.: WO2012/101830
PCT Pub. Date: Aug. 2, 2012

(65) Prior Publication Data

US 2013/0291614 A1 Nov. 7, 2013

(51) Int. Cl.

| | |
|---|---|
| ***B21D 22/02*** | (2006.01) |
| ***B21D 37/10*** | (2006.01) |
| ***B21D 37/20*** | (2006.01) |
| ***B30B 15/02*** | (2006.01) |

(52) U.S. Cl.
CPC ..... *B21D 22/02* (2013.01); *B21D 37/10* (2013.01); *B21D 37/20* (2013.01); *B30B 15/02* (2013.01)

(58) Field of Classification Search
CPC ..... B21D 37/00; B21D 37/02; B21D 11/02; B21D 22/20; B21D 37/10; B21D 37/12; B21D 22/02; B21J 9/00; B21J 9/02; B21J 13/02; B21J 13/04; B30B 15/02; B30B 15/026
USPC ..... 72/412, 446, 448, 450, 455, 456, 462, 72/470, 381, 383, 384, 385; 100/214; 249/132; 425/403; 264/31
See application file for complete search history.

(56) References Cited

U.S. PATENT DOCUMENTS

| | | | | | |
|---|---|---|---|---|---|
| 774,818 | A | * | 11/1904 | Barr | 72/475 |
| 1,449,385 | A | * | 3/1923 | Dieterich | 72/326 |
| 1,940,305 | A | * | 12/1933 | Kapitke et al. | 29/463 |
| 2,133,477 | A | * | 10/1938 | Schade | 72/412 |

(Continued)

FOREIGN PATENT DOCUMENTS

| | | | | |
|---|---|---|---|---|
| DE | 102007023269 | A1 * | 11/2008 | B21D 37/10 |
| EP | 0 570 212 | A1 | 11/1993 | |

(Continued)

OTHER PUBLICATIONS

Written Opinion of the International Searching Authority issued International Application No. PCT/JP2011/051826 dated Mar. 29, 2011 (w/ partial translation).

*Primary Examiner* — Edward Tolan
(74) *Attorney, Agent, or Firm* — Oliff PLC

(57) ABSTRACT

A lightweight mold for press forming is presented. Molds are characterized in that design forming portions thereof, these design forming portions making contact with a workpiece at the time of press forming and thereby forming a target design on the workpiece, are constructed of rod shaped members (design forming rods). By having the design forming portions be constructed of rod shaped members, the weight of the mold is reduced. It is preferred that the molds are further provided with supporting rods which support the design forming rods, these rod members constituting a framework structure.

6 Claims, 4 Drawing Sheets

(56) References Cited

U.S. PATENT DOCUMENTS

| | | | | | |
|---|---|---|---|---|---|
| 2,483,597 | A | * | 10/1949 | Schogren | 72/445 |
| 2,681,027 | A | * | 6/1954 | Boll | 72/21.2 |
| 2,722,174 | A | * | 11/1955 | Albers | 100/269.11 |
| 3,172,453 | A | * | 3/1965 | Lauper | 72/212 |
| 3,418,922 | A | * | 12/1968 | Kip, Jr. | 100/214 |
| 3,845,654 | A | * | 11/1974 | Fuller et al. | 72/381 |
| 3,889,513 | A | * | 6/1975 | Iwasaki et al. | 72/385 |
| 4,088,002 | A | * | 5/1978 | Andrew | 72/389.6 |
| 4,250,735 | A | * | 2/1981 | Spedding | 72/455 |
| 4,615,204 | A | * | 10/1986 | Yamamoto et al. | 72/347 |
| 4,706,490 | A | * | 11/1987 | Zeitlin et al. | 72/455 |
| 4,760,729 | A | * | 8/1988 | Kaminski | 72/456 |
| 4,878,374 | A | * | 11/1989 | Nelson | 72/446 |
| 5,040,966 | A | * | 8/1991 | Weisse | 425/403 |
| 5,184,496 | A | * | 2/1993 | Namba et al. | 72/350 |
| 5,315,856 | A | * | 5/1994 | Mackey | 72/389.6 |
| 5,433,418 | A | * | 7/1995 | Nowak et al. | 249/139 |
| 5,701,651 | A | * | 12/1997 | Groves et al. | 29/281.5 |
| 6,170,560 | B1 | * | 1/2001 | Daily et al. | 164/516 |
| 6,907,820 | B2 | * | 6/2005 | Jin et al. | 100/51 |
| 8,925,365 | B2 | * | 1/2015 | Schollhammer | 72/455 |
| 2013/0255351 | A1 | * | 10/2013 | Nanba et al. | 72/467 |

FOREIGN PATENT DOCUMENTS

| | | | | | |
|---|---|---|---|---|---|
| EP | 2 295 162 | A1 | | 3/2011 | |
| GB | 2094681 | A | * | 9/1982 | B21D 7/06 |
| JP | A-51-141766 | | | 12/1976 | |
| JP | A-1-197027 | | | 8/1989 | |
| JP | A-6-269866 | | | 9/1994 | |
| JP | A-7-16670 | | | 1/1995 | |
| JP | A-07-323400 | | | 12/1995 | |
| JP | A-2003-245728 | | | 9/2003 | |
| KR | 10-0830822 | B1 | | 5/2008 | |

* cited by examiner

MOLD FOR PRESS FORMING

TECHNICAL FIELD

The present invention relates to a mold for press forming.

BACKGROUND ART

Many improvements for molds for press forming have been proposed. For example, Patent Document 1 proposes a device to make it easier to remove a formed workpiece from the mold. Patent Document 2 proposes a mold in which a part of the mold or a punch can be moved, and which can thereby accommodate differing press shapes without exchanging the entire mold.

CITATION LIST

Patent Literatures

Patent Document 1: Japanese Patent Application Publication No. H6-269866

Patent Document 2: Japanese Patent Application Publication No. H7-16670

SUMMARY OF THE INVENTION

Technical Problem

The present specification presents a technique for improving the mold from a viewpoint different from Patent Document 1 and Patent Document 2. The present specification presents a technique for reducing the weight of the mold.

Solution to the Technical Problem

In one aspect of a mold taught in the present specification, a design forming portion of the mold is constructed with a rod shaped member. The design forming portion makes contact with a workpiece during a press forming process and thereby forms a target design on the workpiece. By having the design forming portion be constructed with the rod shaped member, the present invention reduces the weight of the mold. In other words, a design surface for forming the target design on the workpiece is configured of the rod shaped member. Below, the rod shaped member that constitutes the design forming portion is called a design forming rod or a first rod member.

If a member that supports the first rod member (the design forming rod) is also configured of a rod member, the weight is further reduced. Below, the rod member that supports the first rod member is called a supporting rod or a second rod member. The design forming rod and the supporting rod constitute a framework structure. More preferably, with the novel mold taught in the present specification, the design forming rod and the supporting rod constitute a truss structure. The truss structure refers to a structure in which moment does not occur in the rod members, and only load in the axial direction occurs. High strength can be expected from the truss structure. Moreover, for the strength and rigidity of the rod members to withstand the load, the design forming rod and the supporting rod may constitute a Rahmen structure. Further, the Rahmen structure refers to a structure in which both load in the axial direction and moment occur in the rod members.

In the press forming process, a high load is applied from a press machine to the design forming portion (the design forming rod). In order to support the design forming rod strongly, it is preferred that the supporting rod extends parallel to the direction of load applied by the press machine and that a center line of the supporting rod in its longitudinal direction passes through the first rod member. According to such a configuration, the load from the press machine is applied in the axial direction of the supporting rod. Since the rod member is resistant to load in the axial direction, this configuration has the advantage that the load resistance of the design forming rod (the design forming portion) is high.

The mold for press forming requires a block for positioning the mold. Specifically, a block is required for fixing the mold to the press machine. In a more preferred aspect of the above mold, a block for positioning the mold may be connected to the second rod member.

The mold is preferably manufactured by a casting process, in particular, by a full mold casting process.

DESCRIPTION OF EMBODIMENTS

Figure 1:
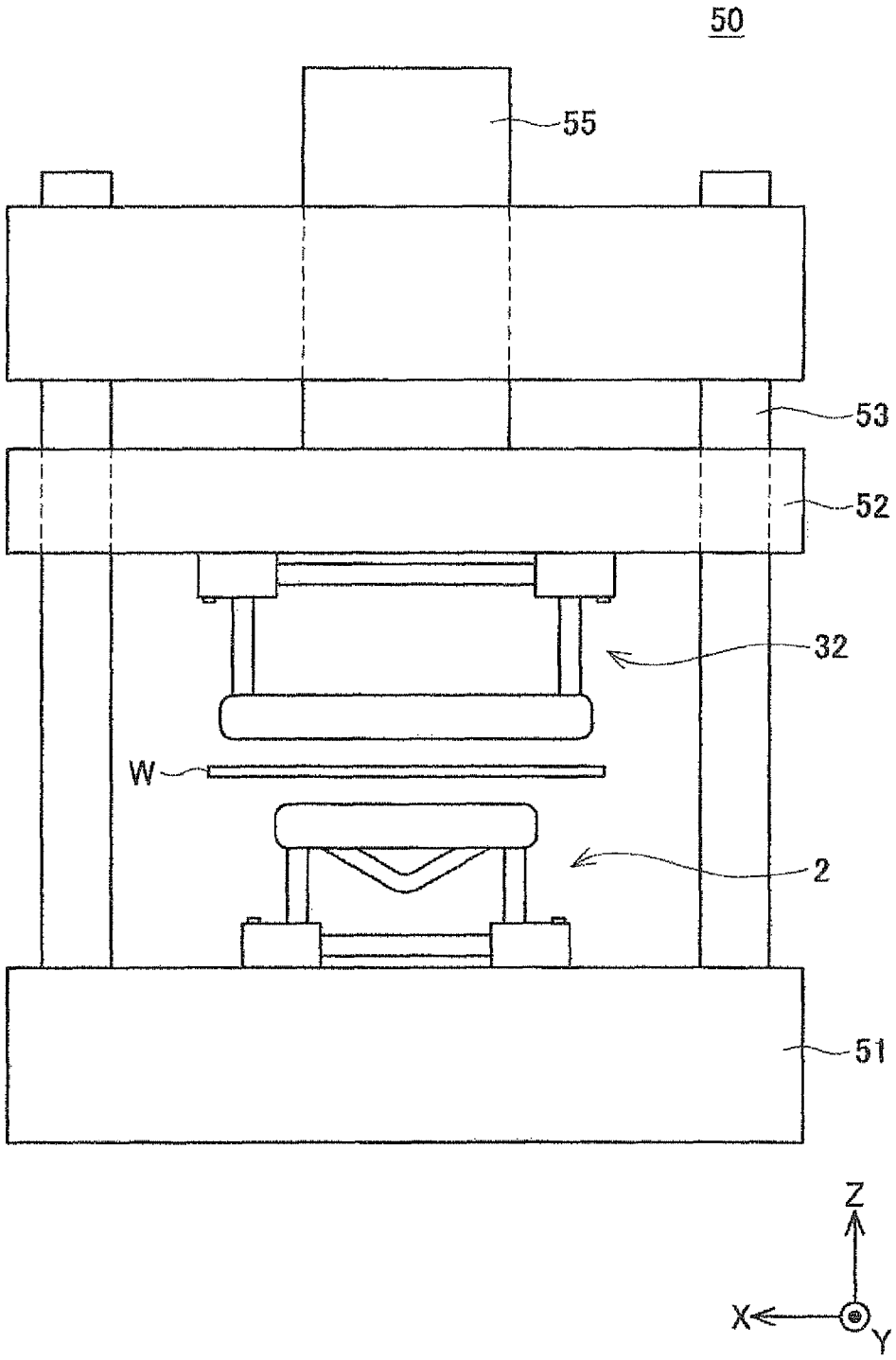
FIG. 1 shows a schematic side view of a press machine.

An embodiment of a mold will be described with reference to figures. To aid understanding, the mold will be described together with a press machine. FIG. 1 is a schematic side view of a press machine 50 having molds 2, 32. The press machine 50 comprises a pair of molds, i.e., the upper mold 32 and the lower mold 2. The lower mold 2 is fixed to a bolster 51 of the press machine 50, and the upper mold 32 is fixed to a slider 52. The slider 52 is moved up and down by an actuator 55 while being guided by supports 53. Moreover, in addition to these parts, the press machine 50 comprises a clamp for retaining a workpiece W, although this clamp is not shown. The clamp is disposed at the sides of the molds 2, 32.

Figure 2:
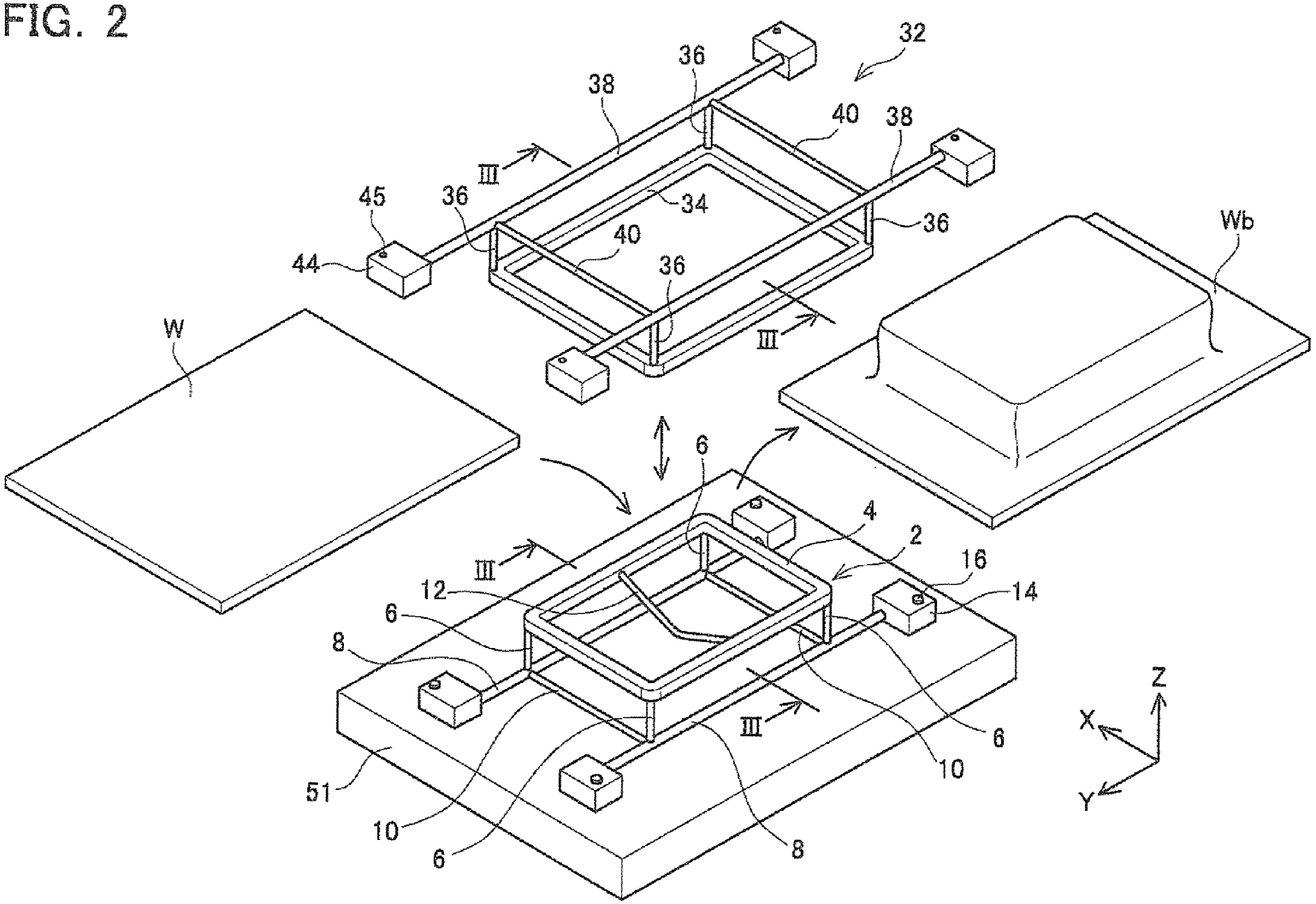
FIG. 2 shows a perspective view of a mold (an upper mold and a lower mold).
Figure 3:
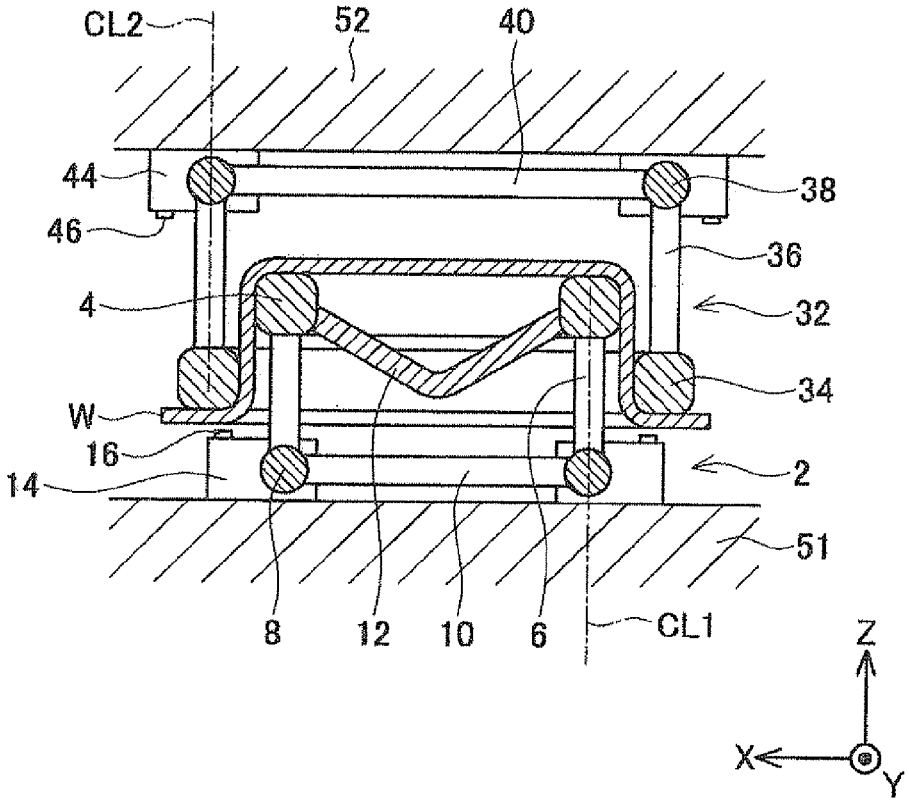
FIG. 3 shows a cross-sectional view of the mold.

FIG. 2 shows a perspective view of the upper mold 32 and the lower mold 2. FIG. 3 shows a cross-sectional view of the upper mold 32 and the lower mold 2. FIG. 3 is equivalent to a cross-section along the line III-III of FIG. 2. Moreover, it should be noted that the bolster 51 supporting the lower mold 2 is shown in FIG. 2, but the slider 52 supporting the upper mold 32 is not shown. Further, FIG. 3 shows the upper mold 32 having been lowered to a lowermost position, this being a state for forming the workpiece W into a target design. As shown in FIGS. 2 and 3, the molds 2, 32 form a flat metal sheet (the workpiece W) into a rectangular convex shape (a workpiece Wb). Moreover, a Z-axis of the coordinates in the figures indicates a direction of movement of the slider 52 (i.e., the upper mold 32). The Z-axis direction also corresponds to the direction of load applied by the press machine 50.

The molds 2, 32 will be described. The lower mold 2 is configured of a design forming rod 4, supporting rods 6, 8, 10, 12, and positioning blocks 14. The upper mold 32 is configured of a design forming rod 34, supporting rods 36, 38, 40, and positioning blocks 44. The design forming rods 4, 34 correspond to design forming portions for forming the workpiece W into the target design.

The structure of the lower mold 2 will be described. A rectangular base is formed by the supporting rods 8 and 10, and the four supporting rods 6 extend parallel to one another in a perpendicular manner from the four corners of this base. The design forming rod 4 is fixed to upper ends of the four supporting rods 6. The design forming rod 4, in entirety, forms a rectangular ring with rounded corners. Further, a cross-section of the design forming rod 4 also forms a rectangle with rounded corners. A part of the cross-section of the design forming rod 4 (a part of a side surface of the design forming rod 4) conforms to a target shape. The supporting rod 12 is attached in order to reinforce the design forming rod 4. As shown in FIG. 3, the vicinity of the center of the supporting rod 12 is bent, so as not to interfere with the workpiece W, toward a back side of the mold (the bolster 51 side). The positioning blocks 14 are connected to end parts of the two supporting rods 8 that extend parallel to one another. When viewing the lower mold 2 from a plan view, the four positioning blocks 14 are seen in four corners surrounding the design forming rod 4. The positioning blocks 14 are parts for fixing the lower mold 2 to the bolster 51 of the press machine. The reference number 16 indicates bolts for fixing the positioning blocks 14 to the bolster 51.

The structure of the upper mold 32 will be described. A rectangular base is formed by the supporting rods 38 and 40, and the four supporting rods 36 extend parallel to one another in a perpendicular manner from the four corners of this base. The design forming rod 34 is fixed to lower ends of the four supporting rods 36. The positioning blocks 44 are connected to end parts of the two supporting rods 38 that extend parallel to one another. When viewing the upper mold 32 from a plan view, the four positioning blocks 44 are seen in four corners surrounding the design forming rod 4. The positioning blocks 44 are parts for fixing the upper mold 32 to the slider 52 of the press machine 50. The reference number 45 indicates through holes through which bolts 46 for fixing the positioning blocks 44 pass.

The overall shape of the design forming rod 34 is similar to the shape of the design forming rod 4 of the lower mold 2. However, the ring of the design forming rod 34 has a size larger than the ring of the design forming rod 4. Specifically, the ring of the design forming rod 34 has the size with which the ring fits with an outside of the ring of the design forming rod 4 with a clearance which is the same as the thickness of the workpiece W. As described above, the workpiece W is sandwiched between the design forming rods 4 and 34, load from above and below is applied, thus forming the target design on the workpiece W. The design forming rods 4, 34 make contact with the workpiece, but the supporting rods do not make contact with the workpiece W. That is, only the design forming rods 4, 34 make contact with the workpiece W, and form the workpiece into a target shape by using the load applied by the press machine 50.

As shown in FIG. 2, in the lower mold 2, the design forming rod 4 and the supporting rods 6, 8, 10 constitute a Rahmen structure (a framework structure). Further, in the upper mold 32, the design forming rod 34 and the supporting rods 36, 38, 40 constitute a Rahmen structure (a framework structure). The molds 2, 32 are almost entirely composed of the rod members. In particular, by having the design forming portions configured of the rod members (design forming rods), the weight can be reduced.

As shown in FIG. 3, each supporting rod 6 extends parallel to the direction in which load is applied by the press machine (the Z-axis direction). A longitudinal center line CL1 of each supporting rod 6 passes through the design forming rod 4. By means of such a structure, the supporting rods 6 catch, as an axial thrust load, the load applied to the design forming rod 4 (the load applied by the press machine). The rod members have a high load resistance for axial thrust loads. Consequently, since the supporting rods 6 receive the load applied by the press machine as an axial thrust load, a high load resistance of the lower mold 2 is realized.

The same applies for the upper mold 32. That is, the supporting rods 36 extend parallel to the direction in which load is applied by the press machine (the Z direction), and a longitudinal center line CL2 of each supporting rod 36 passes through the design forming rod 34. Consequently, the supporting rods 36 of the upper mold 32 also catch, as the axial thrust load, the load which the design forming rod 34 receives from the press machine. The upper mold 32 also realizes a high load resistance.

The molds 2, 32 are made by a casting process, specifically, by full mold casting. Consequently, evaporative patterns having the same shapes as the molds 2 and 32 shown in FIG. 2 are made. The evaporative patterns are made from polystyrene foam. The entire evaporative pattern of the lower mold 2 (or the upper mold 32) may be made in one piece, or may be made as a plurality of separate pieces.

Figure 4:
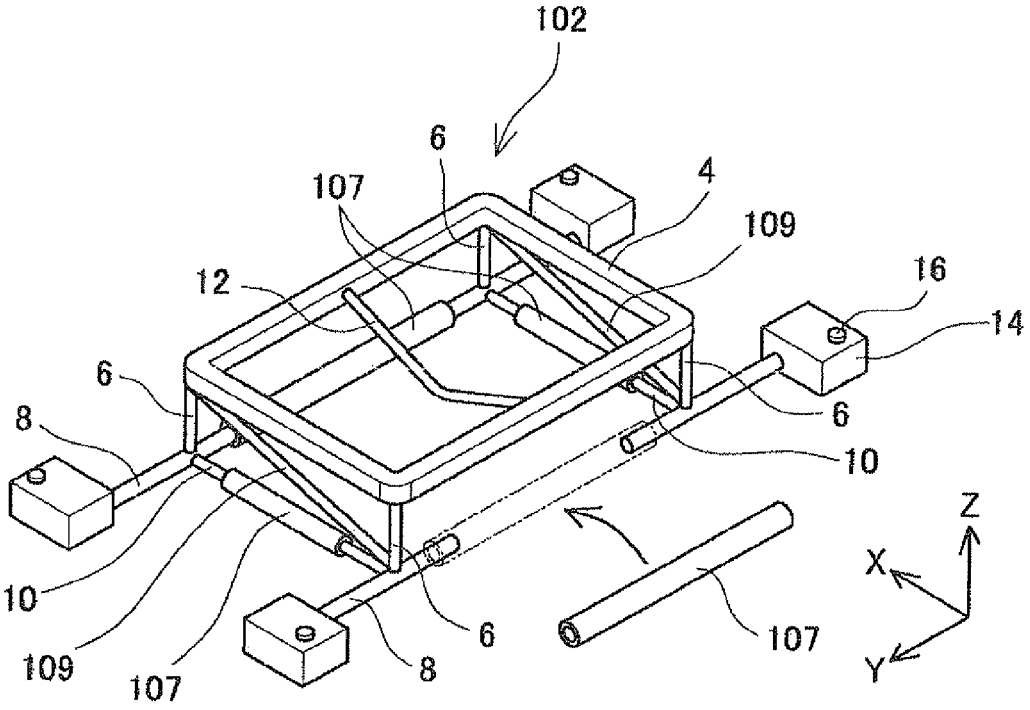
FIG. 4 is a figure illustrating a modification of the mold.

One modification of the mold of the embodiment will be described. FIG. 4 shows a modified lower mold 102. In this lower mold 102, a rod main body 107 (a part other than end joints) of each supporting rod consists of a part separate from the joint portions. Further, a reinforcing member 109 has been added at locations where the strength of the lower mold 102 tends to be insufficient. Each reinforcing member 109 is positioned along the diagonal of a lattice of the framework structure (a lattice surrounded by adjacent rod members). The reinforcing members may be attached at locations other than the locations shown in FIG. 4. The reinforcing members are positioned such that the amount of bending of each part when a scheduled load (or maximum load) is applied to the mold 102 is equal to or less than a predetermined permissible amount. Moreover, the location where the reinforcing member 109 is attached constitutes the truss structure (framework structure). By constituting the truss structure, the lower mold 102 can realize high strength while being lightweight.

Notes concerning the molds 2, 32 of the embodiment will be given. The design forming rods (4, 34) correspond to one aspect of the first rod member. The supporting rods (6, 8, 10, 12, 36, 38, 40) correspond to one aspect of the second rod member. The cross-sectional shape of the design forming rods 4, 34, in particular the shape of the rod end surface that makes contact with the workpiece W, must be made in a shape corresponding to the pressed shape (the target design) of the workpiece. The cross-sectional shape of the supporting rods (6, 8, 10, 12, 36, 38, 40) may be a shape other than round. The cross-sectional shape of the supporting rods may be oval or polygonal. The supporting rods need not be a straight line, but may be bent, like the supporting rod 12, or may be curved.

The molds 2, 32 have a framework structure that includes the design forming portion. Consequently, the molds 2, 32 also have the advantage that removal of the workpiece from the mold after press forming is easy.

The overall shape of the mold, i.e., the shape of the framework structure, is not limited to the shape of the present embodiment. Further, the shape and number of the design forming rods is not limited to the mold of the present embodiment. For example, in order to achieve a complex press shape, the mold may comprise a plurality of design forming rods.

Specific examples of the present invention are described above in detail, but these examples are merely illustrative and place no limitation on the scope of the claims. The technology described in the claims also encompasses various changes and modifications to the specific examples described above. The technical elements explained in the present specification or drawings provide technical utility either independently or through various combinations. The present invention is not limited to the combinations described at the time the claims are filed. Further, the purpose of the examples illustrated by the present specification or drawings is to satisfy multiple objectives simultaneously, and satisfying any one of those objectives gives technical utility to the present invention.

DESCRIPTION OF THE NUMERALS

2: Mold (Lower Mold), 4, 34: Design Forming Rods (First Rod Members), 6, 8, 10, 12, 36, 38, 40: Supporting Rods (Second Rod Members), 14, 44: Positioning Blocks, 32: Mold (Upper Mold), 50: Press Machine, 51: Bolster, 52: Slider, 53: Support, 55: Actuator, 102: Mold (Lower Mold), 107: Rod Main Body, 109: Reinforcing Member

The invention claimed is:

1. A mold for press forming comprising:

an upper mold and a lower mold, the upper mold configured to move relative to the lower mold in a sliding direction;

a first rod member disposed on the lower mold and configured to make contact with a workpiece to form a target design on the workpiece, the first rod member forming a first ring, the first ring being formed in a plane that is substantially perpendicular to the sliding direction;

a second rod member disposed on the lower mold and that supports the first rod member;

a third rod member disposed on the upper mold and configured to make contact with the workpiece to form the target design on the workpiece, the third rod member forming a second ring, the second ring being fomred in a plane that is substantially perpendicular to the sliding direction and having a similar shape as the first ring but with a different size; and a fourth rod member disposed on the upper mold and that supports the third rod member, wherein:

the first and second rod members constitute a framework structure, a cross-section of each of the first and third rod members has a rectangular shape with rounded corners, and the first and second rings are disposed in parallel and form the target design on the workpiece by sandwiching the workpiece between the rounded corner on a side surface of the first rod member and the rounded corner on a side surface of the third rod member.

2. The mold of claim 1, wherein the first and second rod members constitute a structure configured by any one of a Rahmen structure, a truss structure, and a combination of the Rahmen and the truss structure.

3. The mold of claim 1, wherein:

the second rod member extends parallel to a direction of load applied by a press machine; and a center line of the second rod member passes through the first rod member.

4. The mold of claim 1, wherein a block for positioning the mold is connected to the second rod member.

5. The mold of claim 1, wherein the mold is manufactured by a casting process.

6. The mold of claim 1, wherein the third rod member is disposed radially outward of the first rod member when forming the target design on the workpiece.

* * * * *